US009293827B2

(12) United States Patent
Park et al.

(10) Patent No.: US 9,293,827 B2
(45) Date of Patent: Mar. 22, 2016

(54) COMMUNICATION TERMINAL AND ANTENNA APPARATUS THEREOF

(75) Inventors: Hoon Park, Seoul (KR); Jin Kyu Bang, Suwon-si (KR); Sang Min Han, Suwon-si (KR); Sang Ha Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1032 days.

(21) Appl. No.: 13/099,747

(22) Filed: May 3, 2011

(65) Prior Publication Data

US 2011/0273342 A1 Nov. 10, 2011

(30) Foreign Application Priority Data

May 10, 2010 (KR) ..... 10-2010-0043326
Apr. 21, 2011 (KR) ..... 10-2011-0037439

(51) Int. Cl.

| | |
|---|---|
| ***H01Q 1/24*** | (2006.01) |
| ***H01Q 1/38*** | (2006.01) |
| ***H01Q 1/40*** | (2006.01) |
| ***H01Q 1/42*** | (2006.01) |
| ***H01Q 19/00*** | (2006.01) |
| ***H01Q 9/04*** | (2006.01) |

(52) U.S. Cl.
CPC ..... *H01Q 9/0421* (2013.01); *H01Q 1/243* (2013.01); *H01Q 1/245* (2013.01)

(58) Field of Classification Search
CPC ..... H01Q 1/243; H01Q 1/245; H01Q 9/0421; H04B 1/3833
USPC ..... 343/700 MS, 702, 833, 844, 872, 873
See application file for complete search history.

(56) References Cited

U.S. PATENT DOCUMENTS

| | | | | |
|---|---|---|---|---|
| 6,781,556 | B2 | 8/2004 | Kojima et al. | |
| 2006/0092084 | A1 * | 5/2006 | Sakurai | 343/702 |
| 2006/0170599 | A1 * | 8/2006 | Gilmore et al. | 343/702 |
| 2007/0182658 | A1 * | 8/2007 | Ozden | 343/866 |
| 2008/0007468 | A1 | 1/2008 | Sato et al. | |
| 2008/0055160 | A1 | 3/2008 | Kim et al. | |
| 2008/0129611 | A1 * | 6/2008 | Jiang | H01Q 1/2266 343/702 |
| 2008/0252536 | A1 * | 10/2008 | Anguera et al. | 343/702 |
| 2009/0040120 | A1 * | 2/2009 | Tsubaki et al. | 343/702 |
| 2009/0167615 | A1 * | 7/2009 | Teng et al. | 343/702 |
| 2009/0174604 | A1 * | 7/2009 | Keskitalo et al. | 343/700 MS |
| 2010/0103068 | A1 | 4/2010 | Chen et al. | |
| 2010/0109954 | A1 | 5/2010 | Shim et al. | |
| 2011/0248895 | A1 * | 10/2011 | Bungo et al. | 343/702 |

FOREIGN PATENT DOCUMENTS

| | | | |
|---|---|---|---|
| DE | 195 45 224 | A1 | 6/1997 |
| DE | 102 48 756 | A1 | 3/2004 |
| EP | 1 414 107 | A1 | 4/2004 |

(Continued)

*Primary Examiner* — Laura Gudorf
(74) *Attorney, Agent, or Firm* — Jefferson IP Law, LLP

(57) ABSTRACT

A communication terminal and an antenna apparatus of the communication terminal are provided. The communication terminal includes a body having a circuit board, an antenna element which is mounted inside the body and connected electrically to the circuit board and, when electric current is supplied via a main plate, resonant in a resonant frequency band for transmitting and receiving signals, and a metal case having an antenna pattern which is coupled to an edge of the body to be resonant and, when the antenna element is resonant, in the resonant frequency band for supporting operation of the antenna element.

5 Claims, 15 Drawing Sheets

(56) References Cited

FOREIGN PATENT DOCUMENTS

| | | | |
|---|---|---|---|
| EP | 2 015 548 | A1 | 1/2009 |
| WO | 02/21633 | A1 | 3/2002 |
| WO | 02/071534 | A1 | 9/2002 |
| WO | 2007/039071 | A2 | 4/2007 |

* cited by examiner (a)

(b)

(a) (b)

(a) (b)

(a) (b)

(a) (b)

(a) (b)

(a) (b)

(a) (b)

COMMUNICATION TERMINAL AND ANTENNA APPARATUS THEREOF

PRIORITY

This application claims the benefit under 35 U.S.C. §119 (a) of a Korean patent application filed on May 10, 2010 in the Korean Intellectual Property Office and assigned Serial No. 10-2010-0043326, and a Korean patent application filed in the Korean Intellectual Property Office on Apr. 21, 2011 and assigned Serial No. 10-2011-0037439, the entire disclosure of each of which is hereby incorporated by reference.

BACKGROUND OF THE INVENTION

1. Field of the Invention

The present invention relates to a communication terminal and internal apparatus of the terminal. More particularly, the present invention relates to a communication terminal and an antenna apparatus thereof.

2. Description of the Related Art

Recent wireless communication systems are supporting various features, such as the Global Positioning System (GPS), Bluetooth, and Internet access for supporting multimedia services. In order for the multimedia communication system to support the multimedia services effectively, a high data rate for transmitting large amount of multimedia data should be guaranteed. Recently, research is being conducted to improve the performance of the antenna apparatus of a communication terminal in order to improve the data rate. This is because the antenna apparatus is actually responsible to communicate signals carrying multimedia service data.

In addition, recent communication terminals are becoming slim and compact in design for improving portability. Typically, the conventional communication terminal is equipped with an antenna apparatus, such as a load antenna a helical antenna, that is partially extruded out of the terminal housing, and is vulnerable to external impact and resulting limitation on portability. In order to overcome these problems, most recent mobile terminals employ an internal antenna, so called "intenna", built inside the terminal housing. As a consequence, the antenna apparatus is becoming smaller than ever to be mounted in the compact communication terminal.

However, there is a limit to the size of the antenna if the performance of the antenna apparatus over a predetermined level is to be maintained. This is because the mounting space of the antenna apparatus becomes smaller and smaller while the shape and structure of the antenna apparatus are limited more and more due to the reduction of the mounting space. There is, therefore, a need to improve the performance of antenna apparatus of the communication terminal having limited antenna-mounting space.

SUMMARY OF THE INVENTION

Aspects of the present invention are to address at least the above-mentioned problems and/or disadvantages and to provide at least the advantages described below. Accordingly, an aspect of the present invention is to provide an antenna apparatus of a communication terminal that is capable of improving communication performance while maintaining compact design of the communication terminal.

In accordance with an aspect of the present invention, a communication terminal is provided. The communication terminal includes a body having a circuit board, an antenna element which is mounted inside the body and connected electrically to the circuit board and, when electric current is supplied via a main plate, resonant in a resonant frequency band for transmitting and receiving signals, and a metal case having an antenna pattern which is coupled to an edge of the body to be resonant and, when the antenna element is resonant, in the resonant frequency band for supporting operation of the antenna element.

In accordance with another aspect of the present invention, an antenna apparatus of a communication terminal is provided. The antenna apparatus includes a board body having a structure of a flat panel, an antenna element which is arranged at one end of the board body and, when electric current is supplied, resonant in a resonant frequency band for transmitting and receiving radio signals, a ground plate which is arranged on one surface of the board body and contacts the antenna element so as to ground, when the antenna element is resonant, the antenna element, and a parasitic element contacting the ground plate at one end so as to extend the ground plate.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition description of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
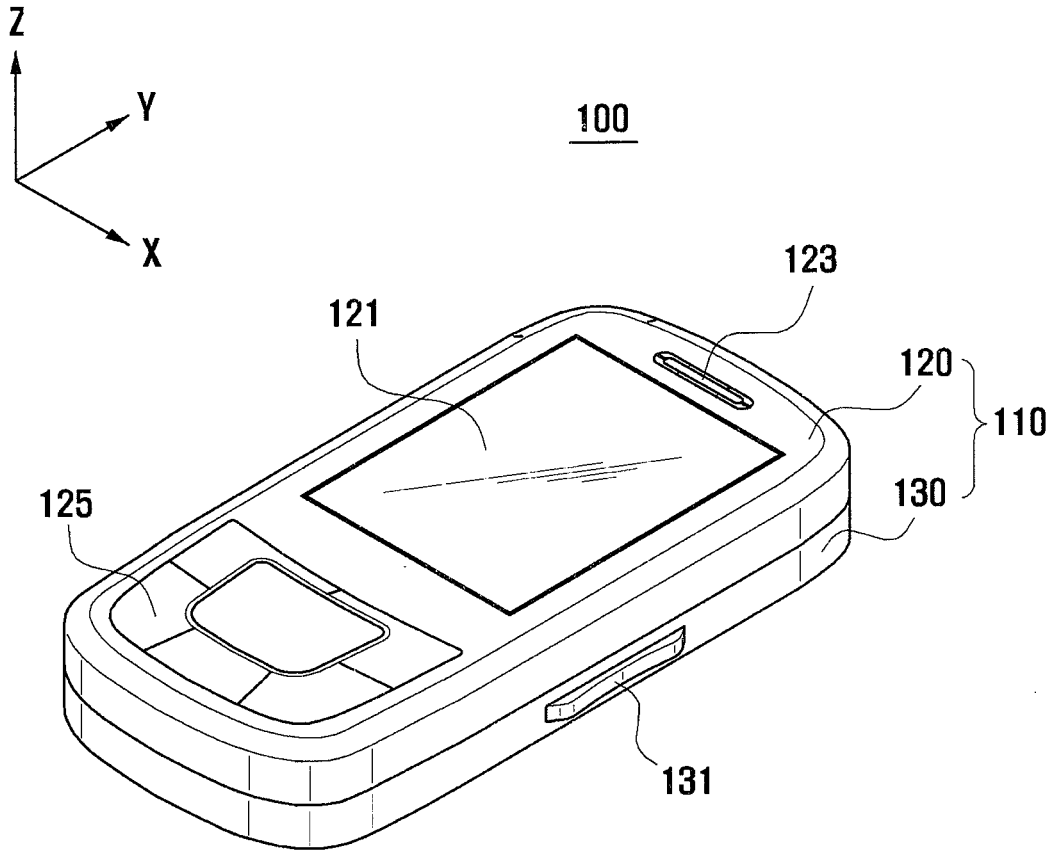
FIG. 1 is a perspective view illustrating a counter of a communication terminal according to an exemplary embodiment of the present invention.

FIG. 1 is a perspective view illustrating a counter of the communication terminal according to an exemplary embodiment the present invention.

Referring to FIG. 1, the communication terminal 100 includes a body 110 and internal function blocks (not shown). The body 110 may include at least one part. In an exemplary case of a bar-type communication terminal 100, the body 110 is formed as a single casing. In the case of a folder type or a slide type communication terminal 100 is composed of an upper body 120 and a lower body 130. The description is provided herein under the assumption that the communication terminal 100 is a slide type terminal, but exemplary embodiments of the present invention may be adapted for other types of communication terminals.

In the communication terminal 100, the upper body 120 and the lower body 130 are slidably coupled to each other. The communication terminal may be in one of two states: a closed state in which the upper and lower bodies 120 and 130 are entirely overlapped, and an open state in which the upper and lower bodies 120 and 130 are partially overlapped. Each of the upper and lower bodies 120 and 130 is composed of an outer case defining internal space for receiving electric devices. The outer case can be made of synthetic resin or metal such as stainless steel or titanium.

The upper body includes a display unit 121, an audio output unit 123, and an upper manipulation unit 125. The display unit 121 displays operation state of the communication terminal 100. The display unit 121 may be implemented with a Liquid Crystal Display (LCD). In this case, the display unit 121 may include an LCD controller, an LCD memory, and LCD devices. When using a touchscreen-enabled LCD, the display unit 121 may function as an input device. The audio output unit 123 outputs audio signals in the form of audible sound. The audio output unit 123 can include a speaker. The upper manipulation unit 125 is provided with a plurality of keys.

The lower body 130 includes a lower manipulation unit 131, an audio input unit (not shown), a memory (not shown), and a control unit (not shown). The lower manipulation unit 131 is provided with a plurality of keys. The audio input unit receives the audio signal. The audio input unit may include a microphone. The memory stores programs for controlling the operations of the communication terminal 100 and data generated by the programs.

Figure 2:
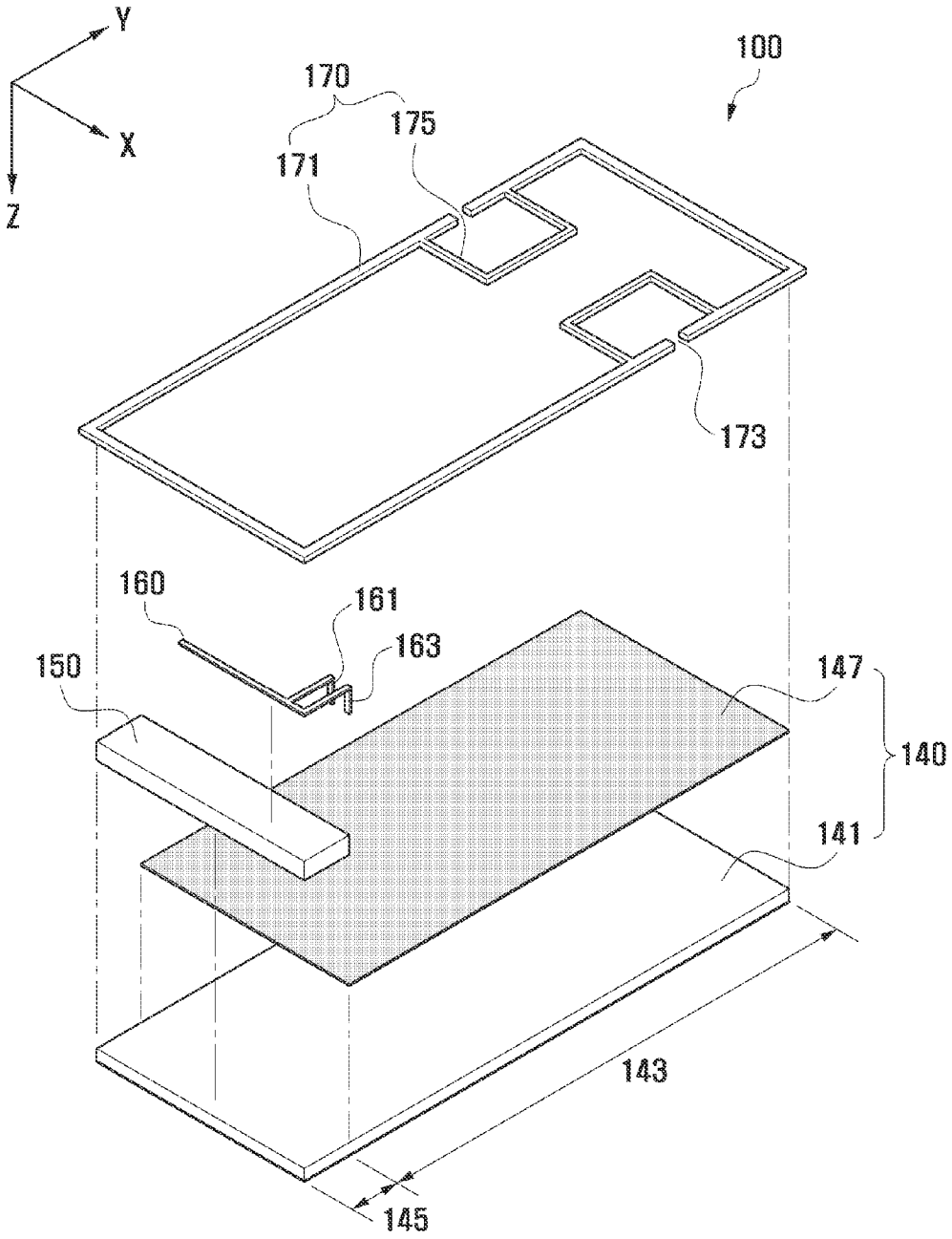
FIG. 2 is an exploded perspective view illustrating disassembled component parts of a communication terminal according to another exemplary embodiment of the present invention.

FIG. 2 is an exploded perspective view illustrating disassembled component parts of a communication terminal according to an exemplary embodiment of the present invention. In this embodiment, the description is made of the internal structure operating as the antenna apparatus in the communication terminal 100.

Referring to FIG. 2, the communication terminal 100 includes a circuit board 140 mounted inside the lower body 130, an element carrier 150, an antenna element 160, and a metal case 170.

The circuit board 140 is provided as a support of the communication terminal 100. The circuit board 140 supports the electronic components of the communication terminal 100. The electronic components, such as a memory and a controller, are mounted on the circuit board 140. The circuit board 140 is also provided with a board body 141 and a ground plate 147.

The board body 141 is provided for power supply and signal transfer on the circuit board 140. A surface of the board body 141 is divided into a group region 143 and an element region 145. The board body 141 is made of a dielectric material having a plurality of power supply lines (not shown). The board body 131 may be formed by laminating a plurality of dielectric plates. Each power supply line is exposed at both ends. One end of the power supply line is connected to an external power source (not shown). The other end of the power supply line may be exposed via the element region. In this manner, the power from the external power source is supplied to the other end of the power supply line.

The ground plate 147 is provided for grounding of the circuit board 140. The ground plate 147 is arranged in the ground region 143 of the board body 141. The ground plate 147 is provided in a plate structure. The ground plate 147 may be arranged horizontally on a surface of the board body 141 so as to cover the entire surface of the ground region 143. The ground plate 147 may be arranged perpendicular to a surface of the board body 141 at a given region. The ground plate 147 may be structured in the form of plate having various types of grooves or holes.

The element carrier 150 is provided as a medium. The element carrier 150 is mounted in the element region 145 of the board body 141. The element carrier 150 is structured in the form of a plate having a certain thickness from the board body. The device carrier 150 exposes an end of each power supply line in the element region 145. The element carrier 150 is shaped so as to correspond to the element region 145 and is protruded inside the element region 145. The element carrier 150 is made of a dielectric material. The element carrier 150 may be formed with the same material as or different material from that of the board body 141. The element carrier can have relatively high loss rate.

The antenna element 160 is responsible for radio communication of the communication terminal 100. The antenna element 160 is resonant at a predetermined resonant frequency band to transmit/receive electromagnetic waves. The antenna element 160 is arranged in the element region 145 of the board body 141. The antenna element 160 is arranged in the element region 145 so as to extend along the surface of the element carrier 150. The antenna element 160 may be arranged so as to have a distance corresponding to the thickness of the element carrier 150 with the board body 141 and the ground plate 147. The antenna element 160 may also be structured to have at least one curved part. The antenna element 160 may be formed in at least one of a meander structure, a spiral structure, a step structure, and a loop structure.

The antenna element 160 is connected to one ends of the power supply lines. A power supply point 161 contacting the power supply line at the antenna element 160 is disposed at one end of the antenna element 160. The antenna element 160 is grounded via the ground plate 147. The antenna element 160 contacts the ground plate 147. The contact point between the antenna element 160 and the ground plate 147, i.e. the contact point 163, is formed at the other end of the antenna element 160. In this manner, when an external power source supplies power via the power supply point 161, the antenna element 160 is resonant at the resonant frequency band. While the antenna element 150 operates, a magnetic field is formed around the antenna element 150.

The metal case 170 is provided to support the communication terminal 100. The metal case 170 prevents the communication terminal 100 from being distorted. The metal case 170 is arranged so as to be engaged around the edge of the lower body 130. The metal case 170 is made of a material having relatively high stiffness. The metal case 170 is provided with a metal frame 171 and an antenna patter 175.

The metal frame 171 of the metal case 170 is provided to maintain the outer contour of the body 110. The metal frame 171 is engaged along the edges inside formed by the outer case of the lower body 130. For example, the metal frame 171 may be formed with a width of 43 mm in the X axis and a length of 97 mm in the Y axis. The metal frame is formed to receive the electronic elements such as circuit board 140, element carrier 150, and antenna element 160. The metal frame 171 is formed as a structure having at least one gap 173. If a plurality of gaps is formed, the metal frame 171 may be divided into a plurality of pieces.

The antenna pattern 175 is provided so as to be resonant in the metal case 170. The antenna pattern 175 supports the resonance of the antenna element 160. When the antenna is resonant, the antenna pattern 175 is resonant along with the antenna element 160 at the resonant frequency. The antenna pattern 175 is extended to the inner space of the lower body 130 from the metal case 170. The antenna pattern 175 is connected to the metal case 170 at both sides of the gap 173. The antenna pattern 175 is integrally connected with the metal frame 171. The antenna pattern 175 may be formed as a structure having at least one curvature. The antenna pattern 175 may be formed in at least one of a meander structure, a spiral structure, a step structure, and a loop structure.

The antenna pattern 175 is made of a metallic material so as to operate as if it is a transmission circuit of the communication terminal 100. When the magnetic field is formed around the antenna element 160, the antenna 160 and the antenna pattern 175 are magnetically coupled with each other, resulting in electricity supply from the antenna element 160 to the antenna pattern 175. During the electricity supply, the antenna pattern 175 is resonant along with the antenna element 160.

Accordingly, the antenna apparatus of the communication terminal 100 according to an exemplary embodiment of the present invention shows improved operation characteristics.

Figure 3:
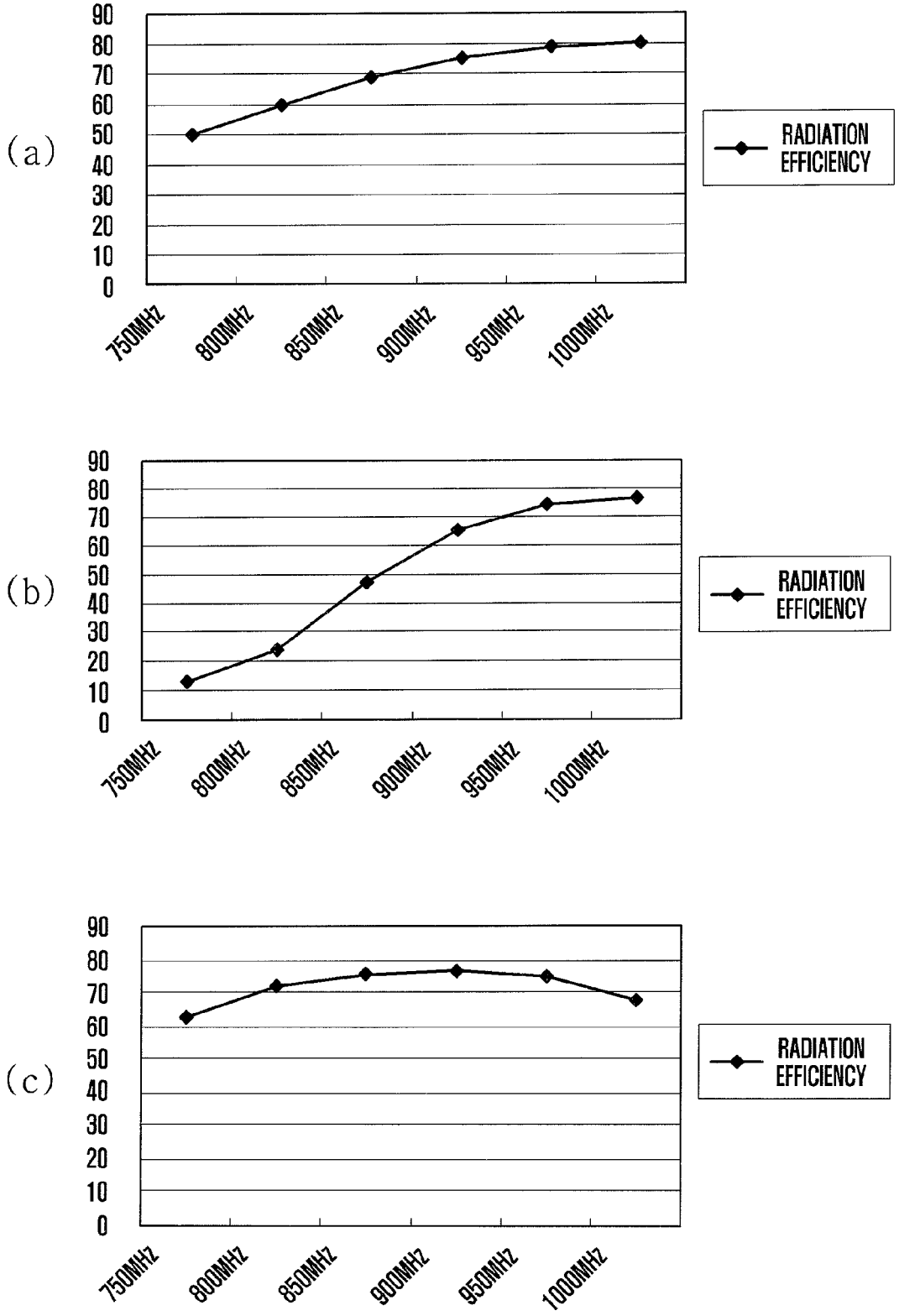
FIG. 3 is a diagram illustrating graphs of radiation efficiency of a communication terminal according to another exemplary embodiment of the present invention.

FIG. 3 is a diagram illustrating graphs of radiation efficiency of a communication terminal according to an exemplary embodiment of the present invention. FIG. 3 shows the radiation efficiency of the antenna apparatus of the communication terminal per frequency band. Graph (a) of FIG. 3 shows the radiation efficiency of the antenna apparatus of the communication terminal configured without the metal case. Graph (b) of FIG. 3 shows the radiation efficiency of the antenna apparatus of the communication terminal configured with the antenna pattern. Graph (c) of FIG. 3 shows the radiation efficiency of the antenna apparatus of the communication terminal configured with the metal case.

Referring to FIG. 3, the antenna apparatus of the communication terminal 100 shows the radiation efficiency exceeding 60% across the relatively extended frequency bandwidth. With the fine adjust of the antenna apparatus of the communication terminal 100, the antenna apparatus shows the radiation efficiencies at respective frequency bands as shown in Table 1. The antenna apparatus of the communication terminal 100 shows improved radiation efficiency in relatively low frequency band, e.g. in the range between 850 MHz and 900 MHz. This means that the antenna apparatus of the communication terminal 100 shows improved radiation efficiency. The antenna apparatus of the communication terminal 100 can acquire significantly improved operation characteristics with the antenna pattern 175 as well as the metal frame 171 as compared to the case configured with any of the metal frame 171 and the antenna pattern.

TABLE 1

| Frequency band | Radiation efficiency (%) | |
|---|---|---|
| (MHz) | Without antenna pattern | With antenna pattern |
| 800 | 26.14 | 23.26 |
| 820 | 30.00 | 27.78 |
| 840 | 25.97 | 43.96 |
| 860 | 16.95 | 32.58 |
| 880 | 16.67 | 34.01 |
| 900 | 14.93 | 40.27 |
| 920 | 11.76 | 45.20 |
| 940 | 20.41 | 56.60 |
| 960 | 40.00 | 65.57 |
| 980 | 66.25 | 68.26 |
| 1000 | 38.99 | 66.07 |

Figure 4:
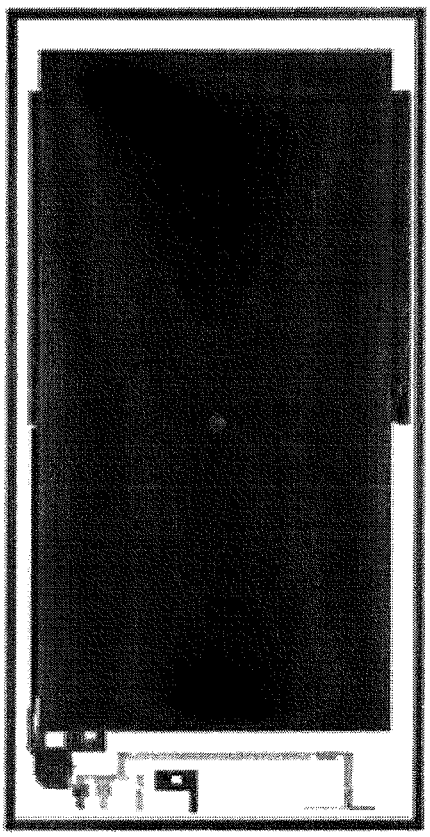
FIG. 4 is diagram illustrating distributions of electric current in an antenna apparatus according to another exemplary embodiment of the present invention.
Figure 4:
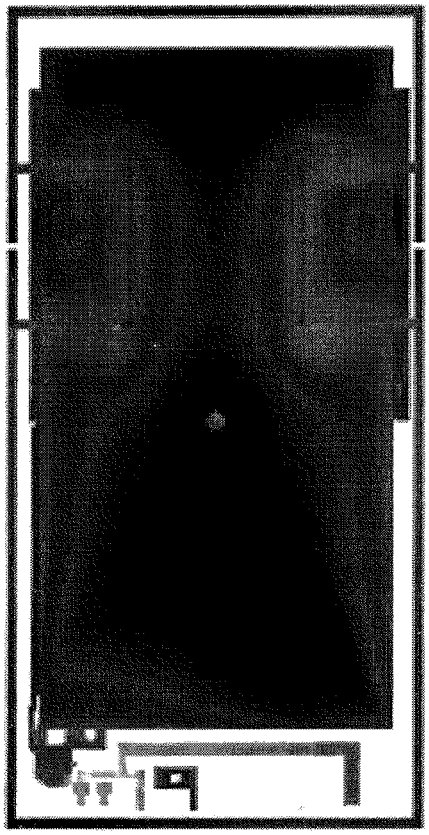

FIG. 4 is a diagram illustrating distributions of electric current in the antenna apparatus of FIG. 2 according to an exemplary embodiment of the present invention. In FIG. 4, the differing shades of gray indicate the strengths of the electric current in descending order. Part (1) of FIG. 4 shows the electric current distribution of the antenna apparatus of the communication terminal configured with the metal frame having the gaps but without antenna pattern. Part (b) of FIG. 4 shows the electric current distribution of the antenna apparatus of the communication terminal configured with the metal case.

Referring to FIG. 4, the antenna apparatus of the communication terminal 100 prevents the current induction to the metal frame 171 by forming gaps on the metal frame. The antenna apparatus of the communication terminal 100 facilitates the operation of the antenna element 150 with the antenna pattern 175 in addition to the metal frame. The electric current flowing to the antenna pattern 175 and the antenna is resonant along with the antenna element 150. As the electric current flows along the antenna pattern 175, it is possible to suppress the electric current induction to the receiver side positioned at an end opposite to the other end where the antenna element 160 is positioned on the circuit board. Accordingly, it is possible to improve the Hearing Aid Compatibility (HAC) of the communication terminal. The antenna apparatus of the communication terminal 100 improves the operation characteristics significantly with the formation of the antenna pattern 175 as well as the metal frame.

The communication terminal 100 may be prevented from being distorted in use with the support of the metal frame 171. Furthermore, the frame 171 is formed to the gaps 173 and the antenna pattern 175 so as to improve the performance of the antenna apparatus. Since the antenna pattern 175 functions as an additional branch element of the antenna element 160, the antenna apparatus can operate more efficiently in relatively low frequency bane. Accordingly, the antenna apparatus of the communication terminal 100 improves the antenna performance while maintaining the compact design of the communication terminal.

Figure 5:
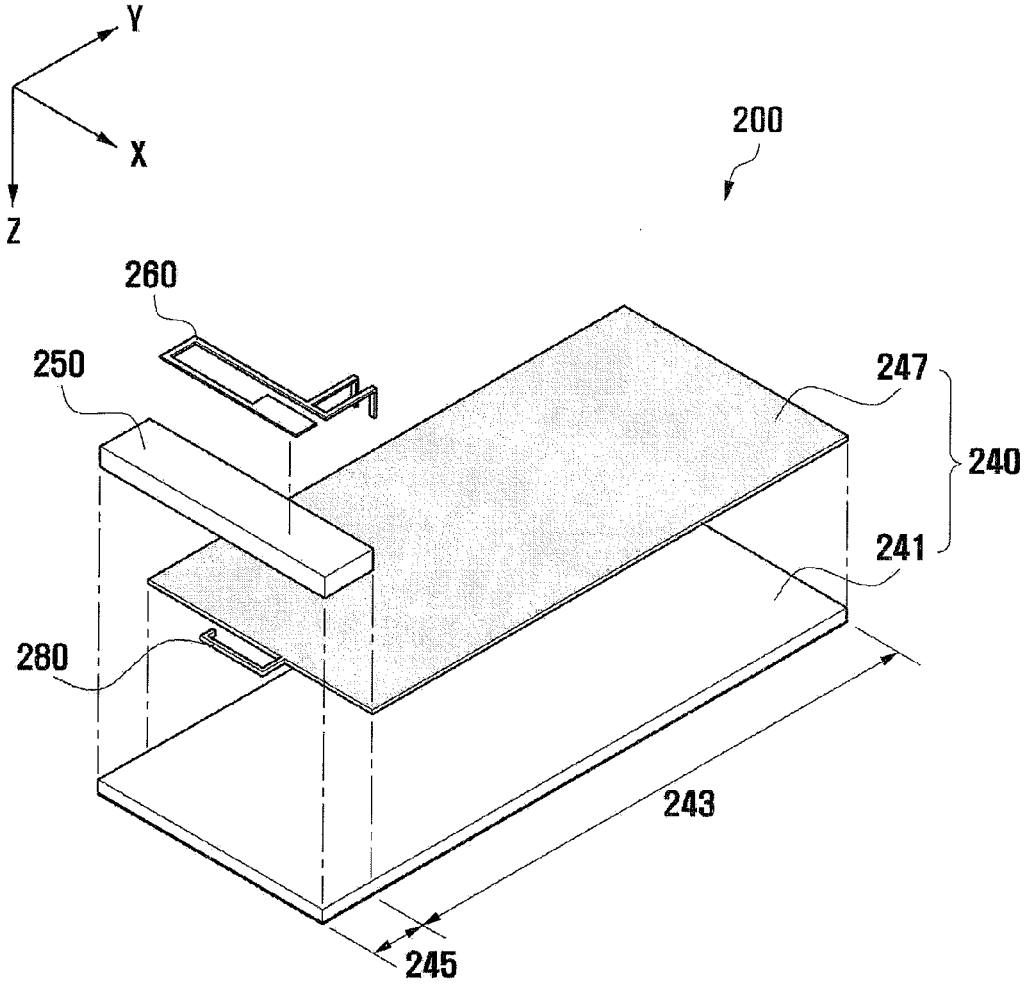
FIG. 5 is an exploded perspective view illustrating disassembled component parts of a communication terminal according to another exemplary embodiment of the present invention.

FIG. 5 is an exploded perspective view illustrating disassembled component parts of a communication terminal according to another exemplary embodiment of the present invention. In this embodiment, a description is made of the internal structure operating as the antenna apparatus in the communication terminal.

Referring to FIG. 5, the communication terminal 200 includes a circuit board 240, an element carrier 250, an antenna element 260, and a parasitic element 280 situated inside the lower body 130. Since the circuit board 240, board body 241, group region 243, element carrier 250, and antenna element 260 are configured as described above with respect to FIG. 2, detailed descriptions thereon is omitted herein.

The parasitic element 280 is provided to support operation of the communication terminal 200. The parasitic element 280 extends the ground plate 247 in the communication terminal 200. The parasitic element 280 is arranged on the element region 245. The antenna element 160 is composed of a transfer circuit made of metallic material. The parasitic element 280 contacts the ground plate 247 at one end within the element region 245 and has an open structure at the other end. The parasitic element 280 is formed so as to have at least one curved part. The parasite element 280 may be formed in at least one of a meander structure, a spiral structure, a step structure, and a loop structure.

The parasitic element 280 is layered with the element carrier 250 and the antenna element 260 at the element region 245. The parasite element 280 is patterned to extend along the surface of the element region 245. The parasitic element 280 may be arranged along with the antenna element on the element carrier 250. The parasitic element 280 and the antenna element 260 may be mounted on the opposite surface of the element carrier 250.

The parasitic element is made of a metallic material so as to operate as a transfer circuit in the communication terminal 200. When the magnetic field is formed around the antenna element 260, the antenna element 260 and the parasitic element 280 are in an excited state. The antenna element 260 and the parasitic element 280 are magnetically coupled, resulting in power supply from the antenna element 260 to the parasitic element 280. When the antenna element is resonant, current in the parasitic element 280 is induced at one end and grounded at the other end. In this manner, the electric current flows from the antenna element 260 to the ground plate 247 directly and via the parasitic element 280.

Accordingly, the antenna apparatus of the communication terminal 200 shows the improved operation characteristics. This is described in detail with reference to FIGS. 6 to 9.

Figure 6:
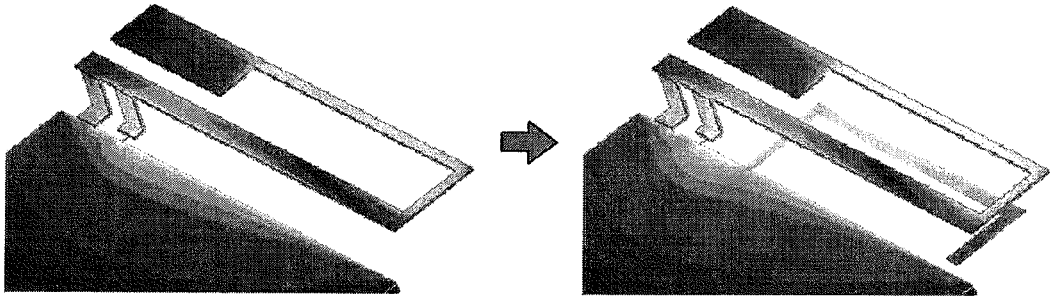
FIG. 6 is a diagram illustrating distributions of electric current around an antenna element according to another exemplary embodiment of the present invention.
Figure 7:
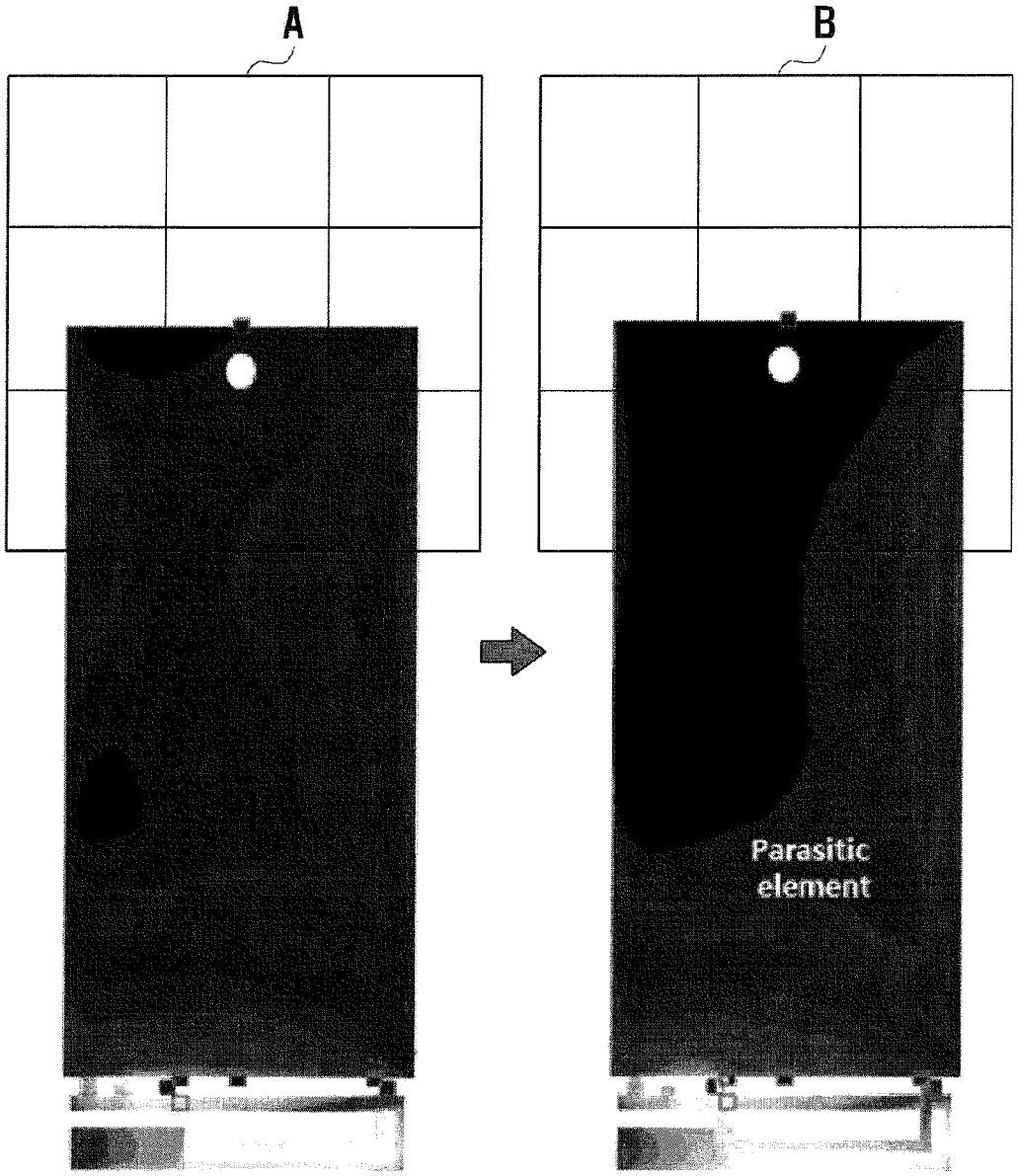
FIG. 7 is a diagram illustrating distributions of electric current in an antenna apparatus according to another exemplary embodiment of the present invention.

FIG. 6 is a diagram illustrating distributions of electric current around an antenna element according to another exemplary embodiment of the present invention. FIG. 7 is a diagram illustrating distributions of electric current in an antenna apparatus according to another exemplary embodiment of the present invention. In FIGS. 6 and 7, the varying shades of gray indicate the strengths of the electric current in descending order. Part (a) of FIG. 6 and part (b) of FIG. 7 show the electric current distributions of the antenna element and antenna apparatus when the communication terminal is configured without the parasitic element. Part (b) of FIG. 6 and part (b) of FIG. 7 shows the electric current distributions of the antenna element and antenna apparatus when the communication terminal is configured with the parasitic element.

Referring to FIGS. 6 and 7, in the antenna apparatus of the communication terminal 200, the electric current transfer path from the antenna element 260 to the ground plate 247 branches out. When the antenna element 260 is resonant, the electric current flows from the antenna element 260 to the ground plate 247 directly and via the parasitic element 280. Since the electric current flows through the parasitic element 280, it is possible to suppress the electric current induction to the receiver side positioned at an end opposite to the other end where the antenna element 160 is positioned on the circuit board. Accordingly, it is possible to improve the HAC of the communication terminal. The antenna apparatus of the communication terminal 200 is capable of improving the operation characteristics significantly with the formation of the parasitic element 280.

Figure 8:
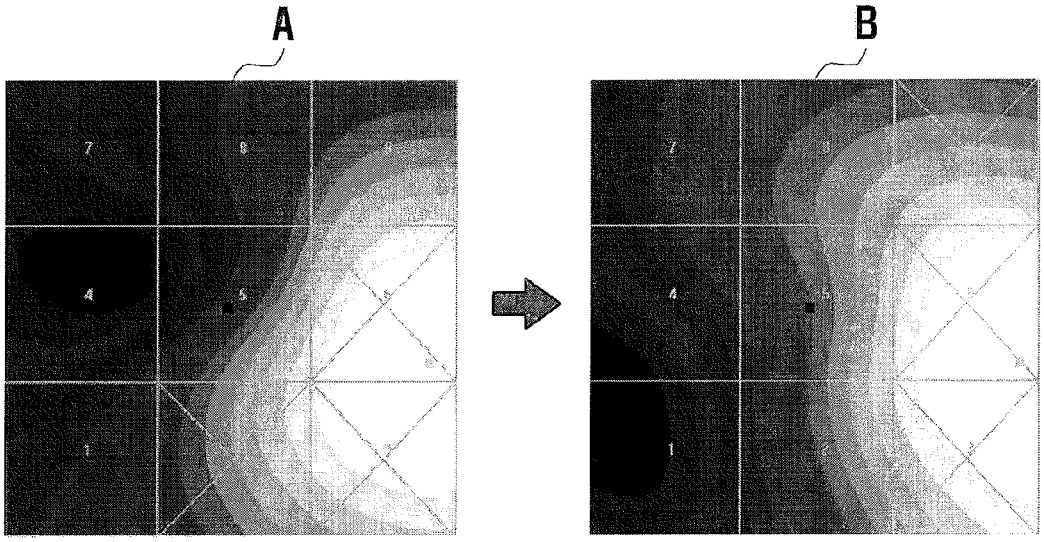
FIG. 8 is a diagram illustrating distributions of electric field of an antenna apparatus according to another exemplary embodiment of the present invention.
Figure 9:
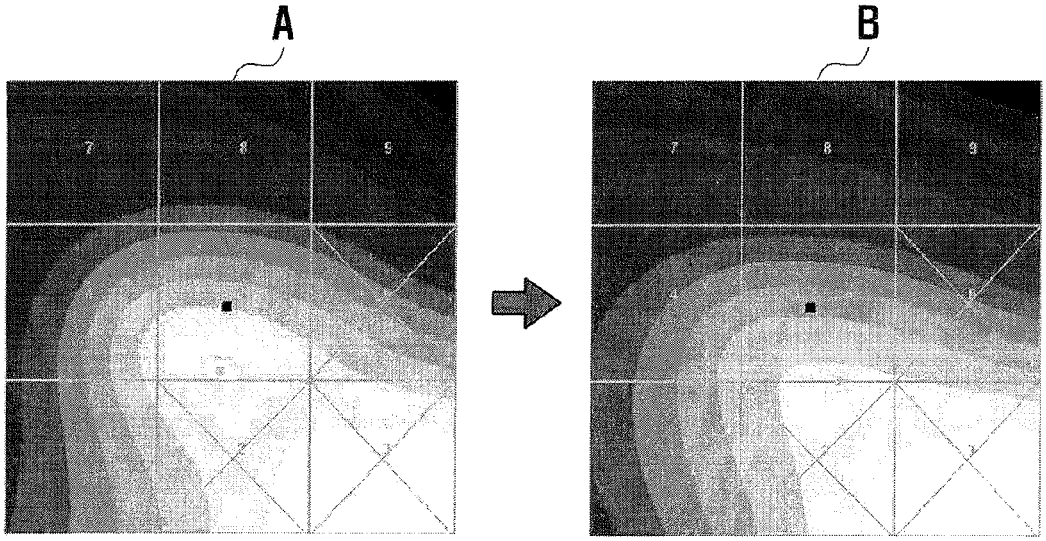
FIG. 9 is a diagram illustrating distributions of a magnetic field (H field) of an antenna apparatus according to another exemplary embodiment of the present invention.

FIG. 8 is a diagram illustrating distributions of electric field of an antenna apparatus according to another exemplary embodiment of the present invention. FIG. 9 is a diagram illustrating distributions of a magnetic field (H field) of an antenna apparatus according to another exemplary embodiment of the present invention.

Referring to FIGS. 8 and 9, the varying shades of gray indicate the strengths of the electric and magnetic fields in descending order. Part (a) of FIG. 8 and part (a) of FIG. 9 show the distributions of the respective electric and magnetic fields of the antenna apparatus of the communication terminal configured without the parasitic element. Part (b) of FIG. 8 and part (b) of FIG. 9 show the distributions of the respective electric and magnetic fields of the antenna apparatus of the communication terminal 200 configured with the parasitic element 280. Part (a) of FIG. 8 and part (a) of FIG. 9 show the electric and magnetic field distributions corresponding to the region A of part (a) of FIG. 7, and part (b) of FIG. 8 and part (b) of FIG. 9 show the electric and magnetic field distributions corresponding to the region B of part (b) of FIG. 7.

In the antenna apparatus of the communication terminal 200, the electric current transfer path from the antenna element 260 to the ground plate 247 branches out. The electric current is delivered to the parasitic element 280 such that the electric and magnetic field distributions formed from the antenna element 260 to the receiver side at an end opposite to the other end where the antenna element 160 is positioned on the circuit board can be changed. The electric field strengths at the regions A and B of FIG. 8 can be expressed with values as shown in Table 2, and the magnetic field strengths at the regions A and B of FIG. 9 can be expressed with values as shown in Table 3. Each of the regions A and B includes sub-regions divided in the form of a grid. The antenna apparatus is capable of weakening the strength of the electric and magnetic field distributions around the receiver side. Accordingly, the antenna apparatus of the communication terminal 200 is capable of improving operations characteristics with use of the metallic parasitic element 280.

TABLE 2

| Electric Field Strength (dBV/m) | | | | | |
|---|---|---|---|---|---|
| A | | | B | | |
| 32.30 | 36.46 | 39.01 | 34.64 | 37.37 | 38.47 |
| 34.08 | 39.54 | 41.29 | 34.46 | 38.13 | 40.25 |
| 35.01 | 39.58 | 41.29 | 32.63 | 38.12 | 40.17 |

TABLE 3

| Magnetic Field Strength (dBA/m) | | | | | |
|---|---|---|---|---|---|
| A | | | B | | |
| −17.02 | −16.83 | −17.52 | −16.80 | −16.80 | −17.20 |
| −13.43 | −12.88 | −13.31 | −13.97 | −13.46 | −13.54 |
| −13.56 | −12.25 | −11.06 | −13.97 | −12.50 | −11.44 |

Figure 10:
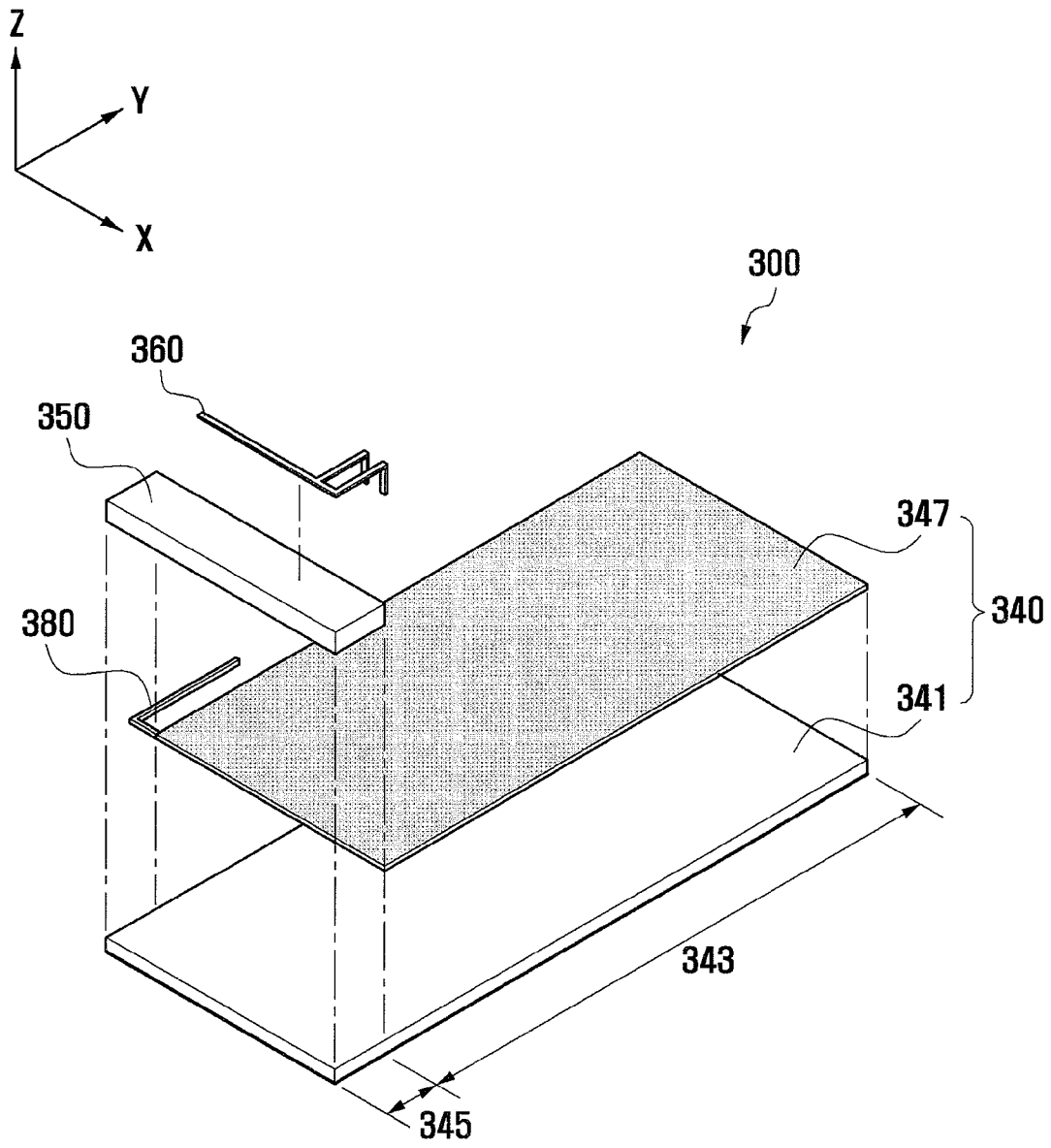
FIG. 10 is an exploded perspective view illustrating disassembled component parts of a communication terminal according to another exemplary embodiment of the present invention.

FIG. 10 is an exploded perspective view illustrating disassembled component parts of a communication terminal according to another exemplary embodiment of the present invention. In this exemplary embodiment, a description is made of the internal structure operating as the antenna apparatus in a communication terminal.

Referring to FIG. 10, the communication terminal 300 includes a circuit board 340, an element carrier 350, and antenna element 360, and a parasitic element 380 situated inside the lower body 330. Since the circuit board 340, board body 341, group region 343, element region 345, element carrier 350, and antenna element 360 are configured as described above with respect to FIG. 2, detailed descriptions thereof is omitted herein.

The parasitic element 380 is provided to support operation of the communication terminal 300. The parasitic element 380 extends the ground plates 347 in the communication terminal. The parasitic element 280 is extended to protrude outside the area of the circuit board 340 from the ground plate 347. For example, the parasitic element 380 may be extruded in the x-axis direction and then extended in the y-axis direction. The antenna element 360 is formed as a transfer circuit made of metallic material. The antenna element 360 contacts the ground plate 347 at one end and opened at the other end. The parasitic element 380 is arranged to have a distance as far as possible from the electric current supply point of the antenna element 360 in x-axis direction and contact the ground plate 347 at a position close to the antenna element 360 in y-axis. The parasitic element 380 can be formed to have at least one curved part. The parasitic element 380 may be formed in at least one of a meander structure, a spiral structure, a step structure, and a loop structure.

The parasitic element 380 is made of a metallic material so as to operate as a transfer circuit in the communication terminal 300. When the electric current flows from the antenna element 360 to the ground plate 347, the electric current also induced to the parasitic element 380. This means that the electric current flows from the antenna element 360 to the ground plate 347 directly and to the parasitic element via the ground plate 347.

Accordingly, the antenna apparatus of the communication terminal 300 shows improved operation characteristics. This is described in detail below with reference to FIG. 11.

Figure 11:
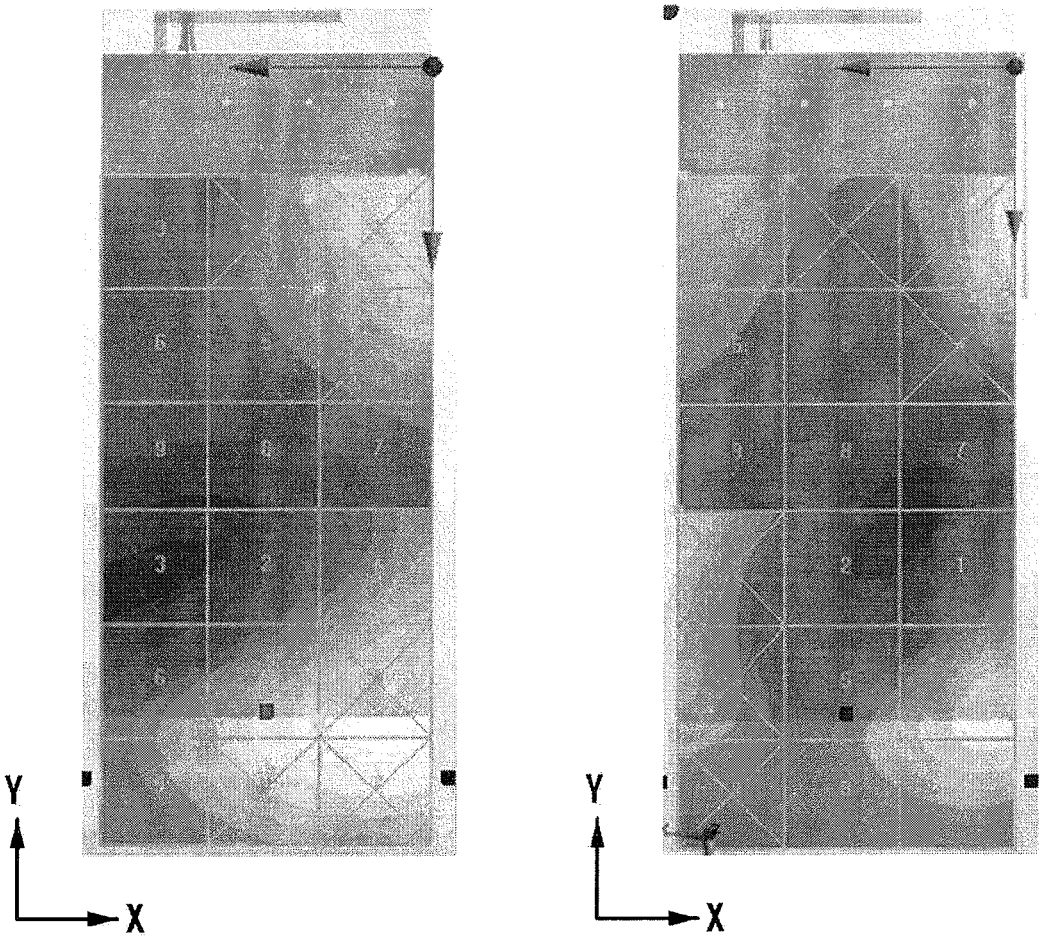
FIG. 11 is a diagram illustrating current distribution of an antenna apparatus according to another exemplary embodiment of the present invention.

FIG. 11 is a diagram illustrating current distribution of an antenna apparatus according to another exemplary embodiment of the present invention. In FIG. 11, the varying shades of gray indicate the strengths of the electric current in descending order. Part (a) of FIG. 11 shows the current distribution of the antenna apparatus of the communication terminal configured without the parasitic element. Part (b) of FIG. 11 shows the current distribution of the antenna apparatus of the communication terminal configured with the parasitic element.

Referring to FIG. 11, the antenna apparatus of the communication terminal 300 distributes the flow path of the current from the antenna element 360 to the ground. When the antenna element is resonant, the electric current flows from the antenna element 360 to the parasitic element 380 as well as from the antenna element 360 to the ground plate 347 directly. By distributing the electric current to the parasitic element 380, it is possible to mitigate the induction of the electric current to the receiver side positioned at an end opposite to the other end where the antenna element 360 is positioned on the circuit board. This means that the antenna apparatus weakens the electric and magnetic fields distributed around the receiver side. Accordingly, it is possible to improve the HAC of the communication terminal. The antenna apparatus of the communication terminal 300 is capable of improving the operation characteristics significantly with the formation of the parasitic element 380.

The communication terminal 200 or 300 is capable of improving the performance of the antenna apparatus using the parasitic element 280 or 380. In the communication terminal 200 or 300, the ground plate 247 or 347 is extended by means of the parasitic element 280 or 380 so as to mitigate current induction from the antenna element 260 or 360 to the receiver side on the circuit board 240 or 340. Accordingly, it is possible to improve the HAC of the communication terminal. Exemplary embodiments of the present invention are capable of improving the performance of the antenna apparatus of the communication terminal 200 or 300 while maintaining the compact design of the antenna apparatus.

Figure 12:
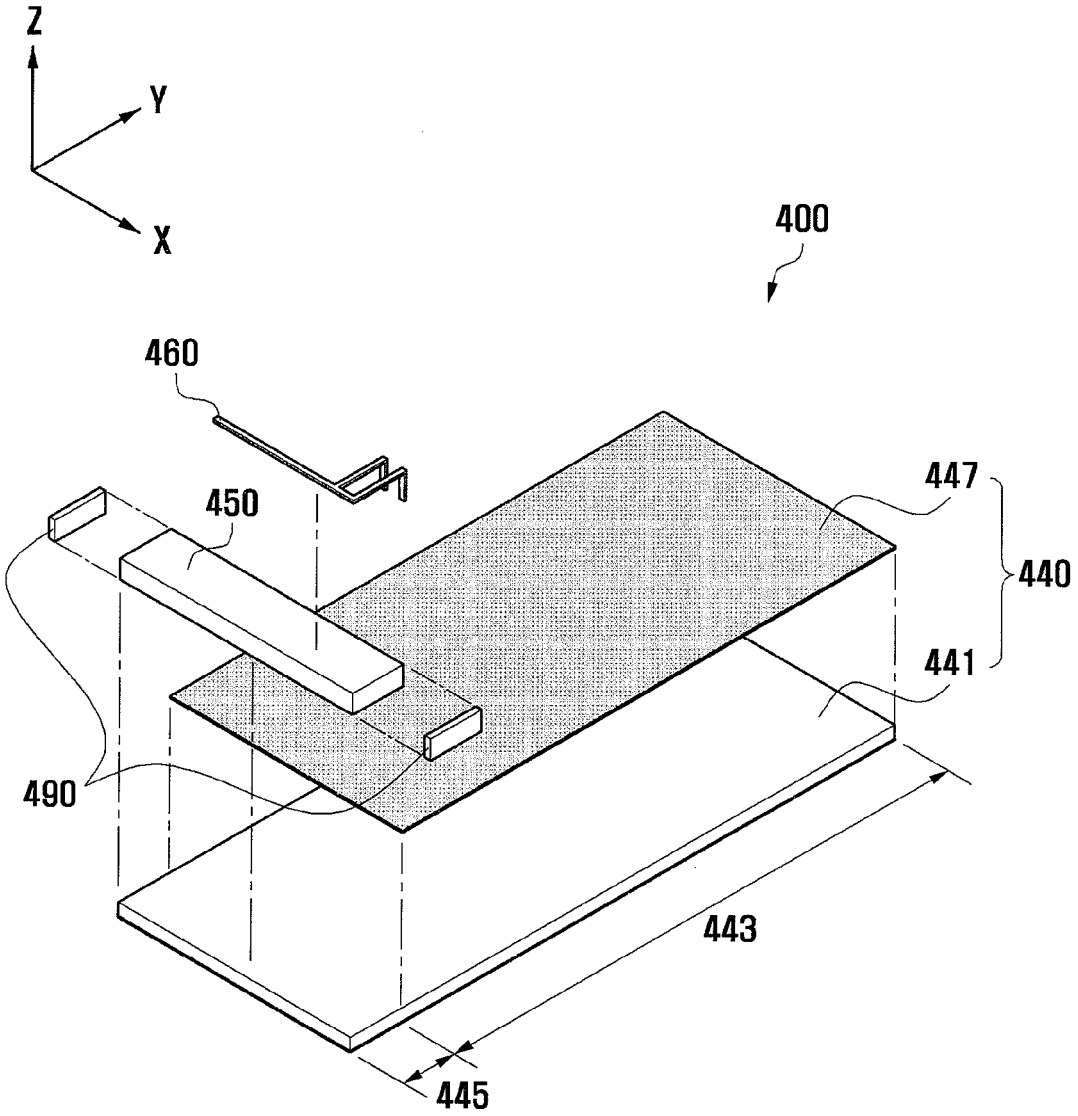
FIG. 12 is an exploded perspective view illustrating disassembled component parts of a communication terminal according to another exemplary embodiment of the present invention.

FIG. 12 is an exploded perspective view illustrating disassembled component parts of a communication terminal according to another exemplary embodiment of the present invention. In this embodiment, a description is made of the internal structure operating as the antenna apparatus in the communication terminal.

Referring to FIG. 12, the communication terminal 400 according to this embodiment of the present invention includes a circuit board 440, an element carrier 450, an antenna element 460, and at least one blocking plate 490 situated inside the low body 130. Since the circuit board 440, element carrier 450, and antenna element 460 are configured in the same manner as shown in FIG. 2, detailed descriptions thereon is omitted herein.

The blocking plates 490 are provided for supporting operation of the communication terminal 400. The blocking plate 490 changes at least one of the radiation pattern and radiation strength of the antenna element 460 in the communication terminal 400. The blocking plate 490 is arranged at a predetermined distance from the antenna element 460. The blocking plate 490 may be mounted on the element carrier 450 or the board bard 441. The blocking plate 490 may be patterned so as to extend along the surface of the element carrier 450 or the board body. The blocking plate 490 may also be mounted on the inner wall of the case of the lower body 130. The blocking plate 490 may be mounted inside the lower body after being separately fabricated or deposited to be formed in the lower body 130. The blocking plate 490 may be arranged at a position opposite to the direction in which the antenna element 460 extends along the element carrier 450 or the board body 441. If the antenna element 460 extends from the electric current supply point to the other end, the blocking plate 490 may be arranged at a position most far from the other end of the antenna element 460. The blocking plate 490 is arranged at the position opposite to the direction in which the antenna element extends such that one of the radiation pattern or radiation strength of the antenna element 460 is altered on the blocking plate, resulting in improvement of performance.

The blocking plate 490 may be formed in various shapes. For example, the blocking plate 490 can be formed in the shape of flat panel or having at least one curvature. If the blocking plate 490 is formed having a curved portion, the blocking plate 490 may have a metal clip structure divided into two parts differentiated by the curved portion. The blocking plate 490 may contact the board body 441 at one end. If the blocking plate 490 has a curved portion, the blocking plate 490 may be configured such that one of the two parts differentiated by the curved portion contacts the board body 441. The blocking plate 490 may be made of a metallic material or other material having electric characteristics similar to the metal. For example, the blocking plate 490 may be formed with electromagnetic interference (EMI) coating. The blocking plate 490 may also be formed as a Flexible Printed Circuit Board (FPCB).

The antenna apparatus of the communication terminal 400 shows improved operation characteristics. This is described in detail below with reference to FIGS. 13 and 14.

Figure 13:
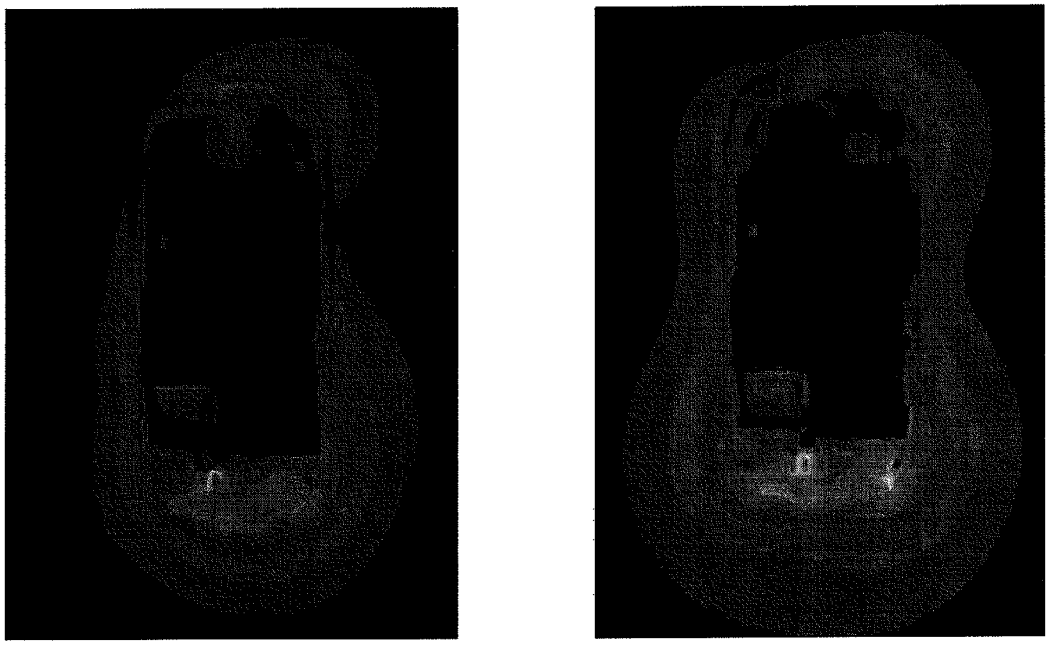
FIG. 13 is a diagram illustrating images of electric field distributions of an antenna apparatus according to another exemplary embodiment of the present invention.
Figure 14:
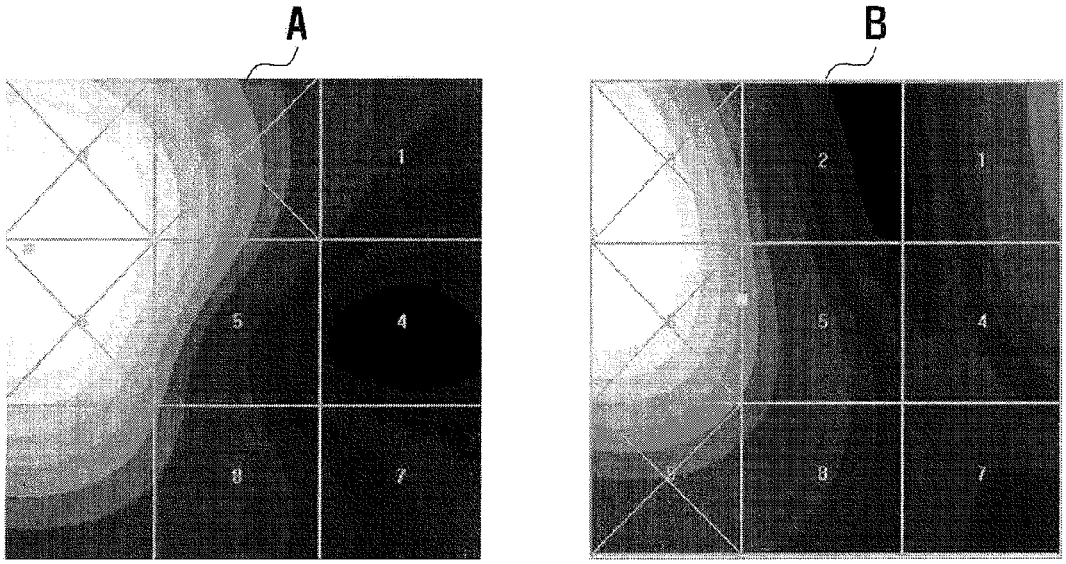
FIG. 14 is a diagram illustrating electric field distribution of an antenna apparatus according to another exemplary embodiment of the present invention.

FIG. 13 is a diagram illustrating images of electric field distributions of an antenna apparatus according to another exemplary embodiment of the present invention. FIG. 14 is a diagram illustrating electric field distribution of an antenna apparatus according to another exemplary embodiment of the present invention. In FIGS. 13 and 14, the varying shades of gray indicate the strengths of the electric current in descending order. Part (a) of FIG. 13 and part (a) of FIG. 14 show the electric field distribution of the antenna apparatus of the communication terminal configured without the blocking plate. Part (b) of FIG. 13 and part (b) of FIG. 14 show the electric field distribution of the antenna apparatus of the communication terminal 400 configured with the blocking plate 490. Part (a) of FIG. 13 and part (a) of FIG. 14 show the electric field distribution corresponding to the region A of part (a) of FIG. 7, and part (b) of FIG. 13 and part (b) of FIG. 14 show the electric field distribution corresponding to the region B of part (b) of FIG. 7.

Referring to FIGS. 13 and 14, the antenna apparatus of the communication terminal 400 alters at least one of the radiation pattern and radiation strength of the antenna element. When the antenna element 460 is resonant, the blocking plate 490 alters the electric current density induced from the antenna element 460 so as to block the electric field formed by the antenna element 460 physically. In this manner, the blocking plate 490 alters the electric filed distribution of the antenna apparatus and antenna element 460. This means that the electric field formed around the receiver side at an end opposite to the antenna element 460 on the circuit board 440 can be altered. The electric field strengths at the regions A and B of FIG. 14 can be expressed with values as shown in Table 4. Each of the regions A and B is divided into sub-regions in the form of a grid. The antenna apparatus of the communication terminal 400 is capable of weakening the strength of the electric and magnetic field distributions around the receiver side.

Accordingly, it is possible to improve the HAC of the communication terminal 400. The antenna apparatus of the communication terminal 400 is capable of improving the operation characteristics significantly with the blocking plate 490, as indicated in Table 4 below.

TABLE 4

| Electric Field Strength (dBV/m) | | | | | |
|---|---|---|---|---|---|
| | A | | | B | |
| 113 | 91.9 | 53.7 | 87.1 | 60.5 | 58.6 |
| 114 | 91.9 | 45.8 | 87.0 | 61.4 | 53.6 |
| 86.3 | 66.1 | 42.5 | 66.5 | 57.4 | 39.9 |

The communication terminal 400 is capable of the performance of the antenna apparatus using the blocking plate 490. By altering at least one of the radiation pattern or radiation strength of the antenna element 460 using the blocking plate 490 in the communication terminal, it is possible to suppress the electric current induction to the receiver side from the antenna element 460 on the circuit board. As a consequence, it is possible to improve the HAC in the communication terminal 400.

The communication terminal 400 is capable of improving the performance of the antenna apparatus while maintaining the compact design of the antenna apparatus.

Although description has been directed to the cases where an element carrier is mounted on the circuit board, exemplary embodiments of the present invention are not limited thereto. For example, the circuit board may be integrated with the ground region 443 without element region 445, and the element carrier can be arranged at a side of the circuit board. Although the description has been directed to the cases where the antenna apparatus is situated in the inner space of the lower body of the communication terminal 400, exemplary embodiments of the present invention are not limited thereto. For example, the antenna apparatus may be mounted in the inner space of the upper body or disposed separately from the upper and low bodies of the communication terminal. Similarly, the parasitic element 280 or 380 may be arranged in the upper body. In the structure where the upper and lower bodies are overlapped, the parasitic element 280 or 380 may be mounted in the upper body so as to contact the ground plate of the circuit board.

According to exemplary embodiments of the present invention, the antenna apparatus may be modified in various shapes in the communication terminal. Descriptions are made of the exemplary cases of such modifications of the antenna apparatus with reference to FIGS. 15 to 17.

Figure 15:
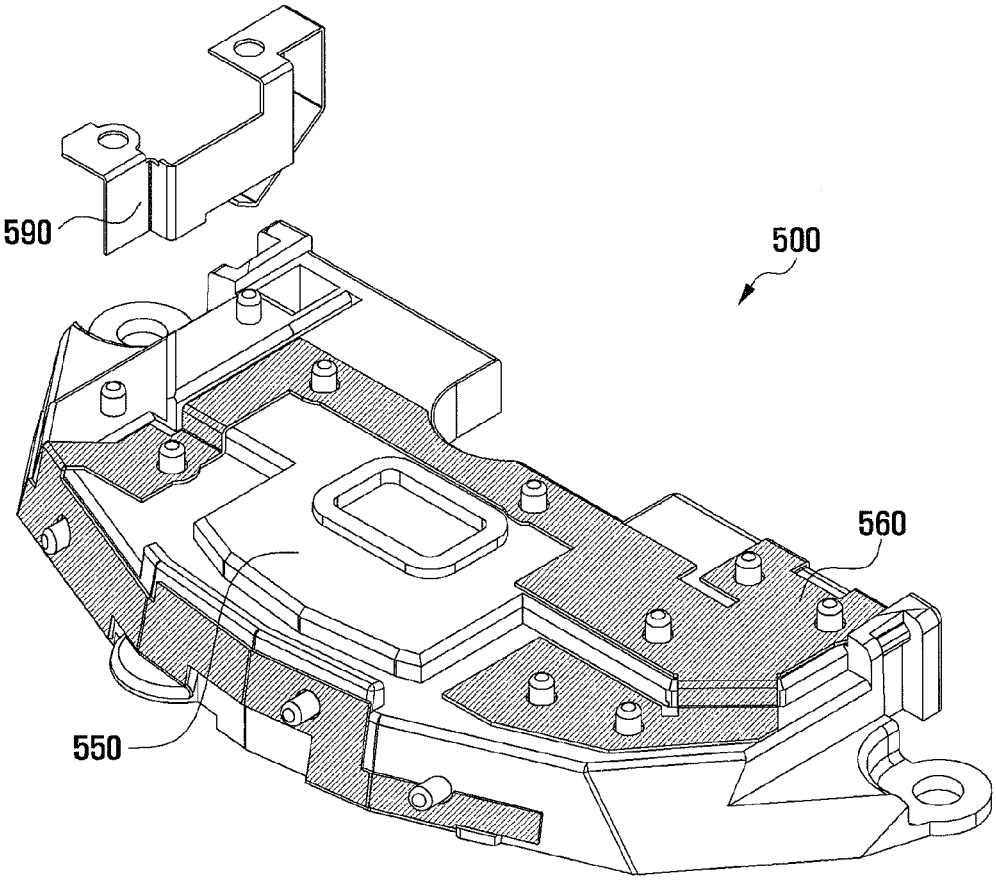
FIG. 15 is a perspective view illustrating an exemplary antenna apparatus of a communication terminal according another exemplary embodiment of the present invention.

FIG. 15 is a perspective view illustrating an exemplary antenna apparatus of a communication terminal according to another exemplary embodiment of the present invention.

Referring to FIG. 15, the antenna apparatus 500 includes an element carrier 550, an antenna element 560, and a blocking plate 590. Since the remaining elements of the antenna apparatus 500 are configured similar to those described above with respect to FIG. 2, detailed descriptions are omitted herein.

The element carrier 550 can be implemented in the shape corresponding to the actual mounting space of the element carrier 550 within the inner space formed in the case of the communication terminal. The element carrier 550 is formed to have insert grooves extending from outer surface to inside or insert holes penetrating to connect the outer surfaces. The insert grooves or insert holes are formed near the boundary regions of the element carrier 550. The antenna element 560 is arranged at a predetermined distance from the insert grooves or insert holes such that the insert grooves or the insert holes are exposed. The blocking plate 590 is inserted in at least some part of the element carrier 550 so as to be mounted on the element carrier 550. The blocking plate 590 is inserted into the element carrier 550 through the insert grooves or the insert holes. The blocking plate 590 is arranged at a predetermined a distance from the antenna element 560. If the blocking plate 590 has a curved portion, the blocking plate 590 is mounted on the outer surface of the element carrier 550 via one of the two parts divided by the curved portion.

Figure 16:
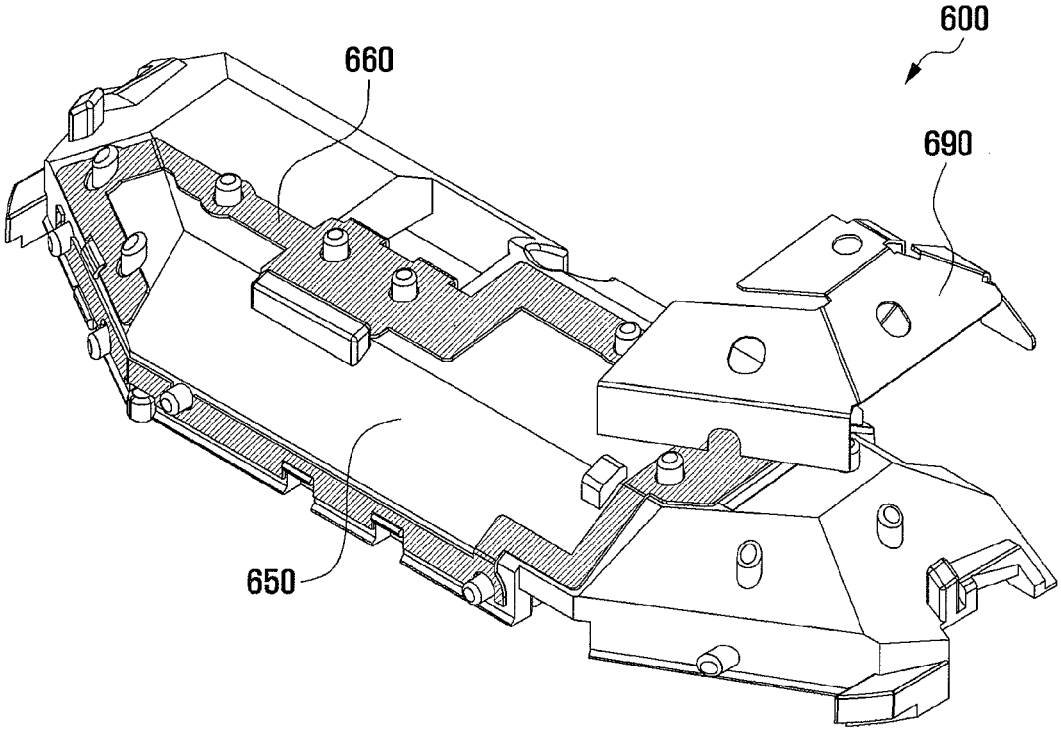
FIG. 16 is a perspective view illustrating another exemplary antenna apparatus of the communication terminal according another exemplary embodiment of the present invention.

FIG. 16 is a perspective view illustrating another exemplary antenna apparatus of a communication terminal according to another exemplary embodiment of the present invention.

Referring to FIG. 16, the antenna apparatus 600 includes an element carrier 650, an antenna element 660, and a block plate 690. Since the remaining elements of the antenna apparatus 600 are configured similar to those described above with respect to FIG. 2, detailed descriptions are omitted herein.

The element carrier 650 may be implemented in the shape corresponding to the actual mounting space of the element carrier 550 within the inner space formed in the case of the communication terminal. The element carrier 650 may have a slope inclined at a predetermined angle. The antenna element 660 extends along the surface of the element carrier 650. The antenna element 660 is arranged at a predetermined distance from at least one side. The blocking plate 690 extends along the surface of the element carrier 690. The blocking plate 690 is arranged at a predetermined distance from the antenna element 660. The blocking plate 690 may be arranged on at least one side of the element carrier 650. The blocking plate 690 may have a slant at a predetermined angle relative to the antenna element 660. If the blocking plate 690 has a curved portion, the blocking plate 690 can be mounted on the same outer surface of the element carrier 650 along with the antenna element 660 via at least one of two parts divided by the curved portion.

Figure 17:
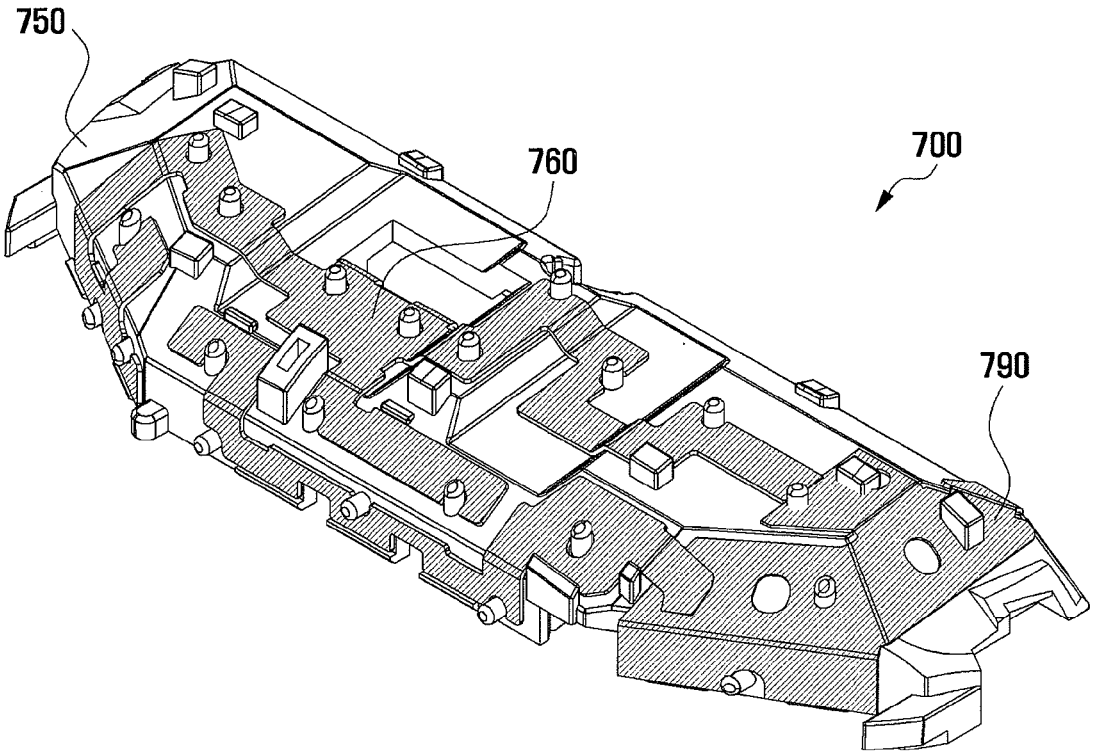
FIG. 17 is a perspective diagram illustrating another exemplary antenna apparatus of the communication terminal according another exemplary embodiment of the present invention.

FIG. 17 is a perspective diagram illustrating another exemplary antenna apparatus of the communication terminal according to another exemplary embodiment of the present invention.

Referring to FIG. 17, the antenna apparatus 700 includes an element carrier 750, an antenna element 760, and a blocking plate 790. Since the remaining elements of the antenna apparatus 700 are configured similar to those described above with respect to FIG. 2, detailed descriptions are omitted herein.

The element carrier 750 has a shape corresponding to the actual mounting space of the element carrier 750 within the inner space formed in the case of the communication terminal. The element carrier 750 may have a slope inclined at a predetermined angle. The antenna element 760 extends along the surface of the element carrier 750. The antenna element 760 is arranged at a predetermined a distance from at least one side. The blocking plate 790 extends along the surface of the element carrier. The blocking plate 790 is connected to the antenna element 750. The blocking plate 790 may be arranged at a side of the element carrier 750. The blocking plate 790 may be arranged to be inclined at a predetermined angle in correspondence to the antenna element 760. If the blocking plate 790 has a curved portion, the blocking plate 790 may be mounted on the outer surface of the element carrier 750 via at least one of two parts divided by the curved portion.

Although the descriptions have been directed to the cases where the communication terminal has at least one of a metal case, a parasitic element, and a blocking plate, exemplary embodiments of the present invention are not limited thereto. Exemplary embodiments of the present invention may be applied to the case where the communication terminal includes at least two of the metal case, parasitic element, and blocking plate.

As described above, the communication terminal and antenna apparatus of the communication terminal according to exemplary embodiments of the present invention is capable of improving the performance of the antenna apparatus of the communication terminal while maintaining the compact design of the antenna apparatus. The communication terminal according to exemplary embodiments of the present invention is capable of preventing the terminal body from being distorted. Exemplary embodiments of the present invention are also capable of mitigating electric current induction to the receiver side from the antenna element in the communication terminal. As a consequence, it is possible to improve the HAC of the communication terminal.

While the invention has been shown and described with reference to certain exemplary embodiments thereof, it will be understood by those skilled in the art that various changes in form and details may be made therein without departing from the spirit and scope of the invention as defined in the appended claims and their equivalents.

What is claimed is:

1. A communication terminal comprising:

a body having a circuit board;

an antenna element which is mounted inside the body and connected electrically to the circuit board and, when electric current is supplied via a main plate, resonant in a resonant frequency band for transmitting and receiving signals; and a metal case having an antenna pattern which is coupled to an edge of the body to be resonant and, when the antenna element is resonant, in the resonant frequency band for supporting operation of the antenna element, wherein the metal case is provided with at least one gap and a metal frame connected to the antenna pattern at both sides of the gap, wherein the metal frame maintains an outer contour of the body and is engaged on an inside edge of the body, and wherein the gap is a complete break in the metal case that is bridged by the metal frame.

2. The communication terminal of claim 1, wherein the circuit board comprises:

a board body structured as a flat panel;

a ground plate which is arranged on one surface of the board body, contacts the antenna element, and grounds, when the antenna element is resonant, the antenna element; and a parasitic element which contacts the ground plate at one end so as to extend the ground plate.

3. The communication terminal of claim 1, further comprising at least one blocking plate which is arranged around the antenna element at a predetermined distance from the antenna element and alters, when the antenna element is resonant, at least one of a radiation pattern or a radiation strength of the antenna element.

4. The communication terminal of claim 1, wherein the antenna pattern has a plurality of curved portions in the form of at least one of a meander structure, a spiral structure, a step structure, and a loop structure.

5. The communication terminal of claim 1, wherein the antenna element has a plurality of curved portions in the form of at least one of a meander structure, a spiral structure, a step structure, and a loop structure.

* * * * *